US012180978B2

(12) United States Patent
Lai et al.

(10) Patent No.: US 12,180,978 B2
(45) Date of Patent: Dec. 31, 2024

(54) FAN FRAME WITH NOISE MUFFLING STRUCTURE

(71) Applicant: ASIA VITAL COMPONENTS CO., LTD., New Taipei (TW)

(72) Inventors: Hua Lai, New Taipei (TW); Ze-Hua Tan, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 79 days.

(21) Appl. No.: 18/058,738

(22) Filed: Nov. 24, 2022

(65) Prior Publication Data

US 2023/0349394 A1 Nov. 2, 2023

(30) Foreign Application Priority Data

Apr. 27, 2022 (TW) ..... 111116042

(51) Int. Cl.
*F04D 29/52* (2006.01)
*F04D 19/00* (2006.01)
*F04D 29/66* (2006.01)

(52) U.S. Cl.
CPC ..... *F04D 29/663* (2013.01); *F04D 19/002* (2013.01); *F04D 29/522* (2013.01)

(58) Field of Classification Search
CPC ..... F04D 29/663; F04D 19/002; F04D 29/522
See application file for complete search history.

(56) References Cited

U.S. PATENT DOCUMENTS 10,151,324 B2 * 12/2018 Amin-Shahidi .... F04D 25/0613
2013/0302190 A1 * 11/2013 Koike ..... F04D 29/601 417/423.14
2018/0080479 A1 * 3/2018 Yang ..... F04D 29/023
2018/0195526 A1 * 7/2018 Hakozaki ..... F04D 29/34
2020/0400156 A1 * 12/2020 Sun ..... F04D 29/665

FOREIGN PATENT DOCUMENTS

JP 4-265500 A 9/1992

OTHER PUBLICATIONS

Search Report dated Oct. 20, 2022 issued by Taiwan Intellectual Property Office for counterpart application No. 111116042.

* cited by examiner

*Primary Examiner* — Aaron R Eastman
(74) *Attorney, Agent, or Firm* — Bradley J. Thorson; DeWitt LLP

(57) ABSTRACT

A fan frame with noise muffling structure includes a frame having a top and a bottom and defining a centered air flow passage that extends from the top to the bottom. The air flow passage has an air inlet and an air outlet formed on the top and the bottom, respectively. The frame further has a noise muffling zone in at least one area of the frame located between the air flow passage and an outer periphery of the frame. In the noise muffling zone, there is provided at least one noise muffling unit, which is located between the top and the bottom without communicating with the air flow passage. The noise muffling unit internally defines a hollow cavity, which is closed between but not extended through the top and the bottom. The hollow cavity isolates air flow noise and absorbs frame vibration and noise produced by the frame vibration.

6 Claims, 3 Drawing Sheets

FAN FRAME WITH NOISE MUFFLING STRUCTURE

This application claims the priority benefit of Taiwan patent application number 111116042 filed on Apr. 27, 2022.

FIELD OF THE INVENTION

The present invention relates to a fan frame, and more particularly, to a fan frame with noise muffling structure.

BACKGROUND OF THE INVENTION

Owing to the constant progress in scientific technologies, integrated circuits and electronic elements now become miniaturized in size, and their arrangement in the same unit area is much denser than before. While this situation enables electronic devices to have more powerful computing ability and more functions, it also necessitates good heat dissipation design to maintain the electronic devices at normal working temperature. Cooling fans are commonly seen devices for heat dissipation. When the fan blades rotate, external cool air flows are sucked into the electronic devices to achieve good air cooling effect. A general cooling fan often produces unpleasant noise when it is operating. This is because, when the fan blades rotate to drive air flows into an air flow passage of the cooling fan, the air flows sucked in would vibrate and collide with the entire fan frame to produce broadband noise. This is a problem that must be solved in the technical field of fan.

It is therefore tried by the inventor to solve the above problem and disadvantage.

SUMMARY OF THE INVENTION

A primary object of the present invention is to provide a fan frame with noise muffling structure, so as to absorb frame vibration and reduce the broadband noise produced by the frame vibration and the collision of air flows with the frame.

To achieve the above and other objects, the fan frame with noise muffling structure according to the present invention includes a frame having a top and a bottom. The frame internally defines a centered air flow passage that extends from the top to the bottom and has an air inlet and an air outlet formed on the top and the bottom, respectively. At least one area of the frame located between the air flow passage and an outer periphery of the frame is a noise muffling zone, in which at least one noise muffling unit is provided and located between the top and the bottom without communicating with the air flow passage. The at least one noise muffling unit internally defines a hollow cavity, which is closed in between but not extended through the top and the bottom.

Since the hollow cavity of the noise muffling unit is closed in between the top and the bottom of the frame, it can effectively isolate noise, absorb frame vibration and reduce the broadband noise produced by the frame vibration.

The noise muffling unit can be a hole or a recess having a round, square, triangular, curved, oval, rectangular or irregular cross section.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

The present invention will now be described with some preferred embodiments thereof.

Figure 1:
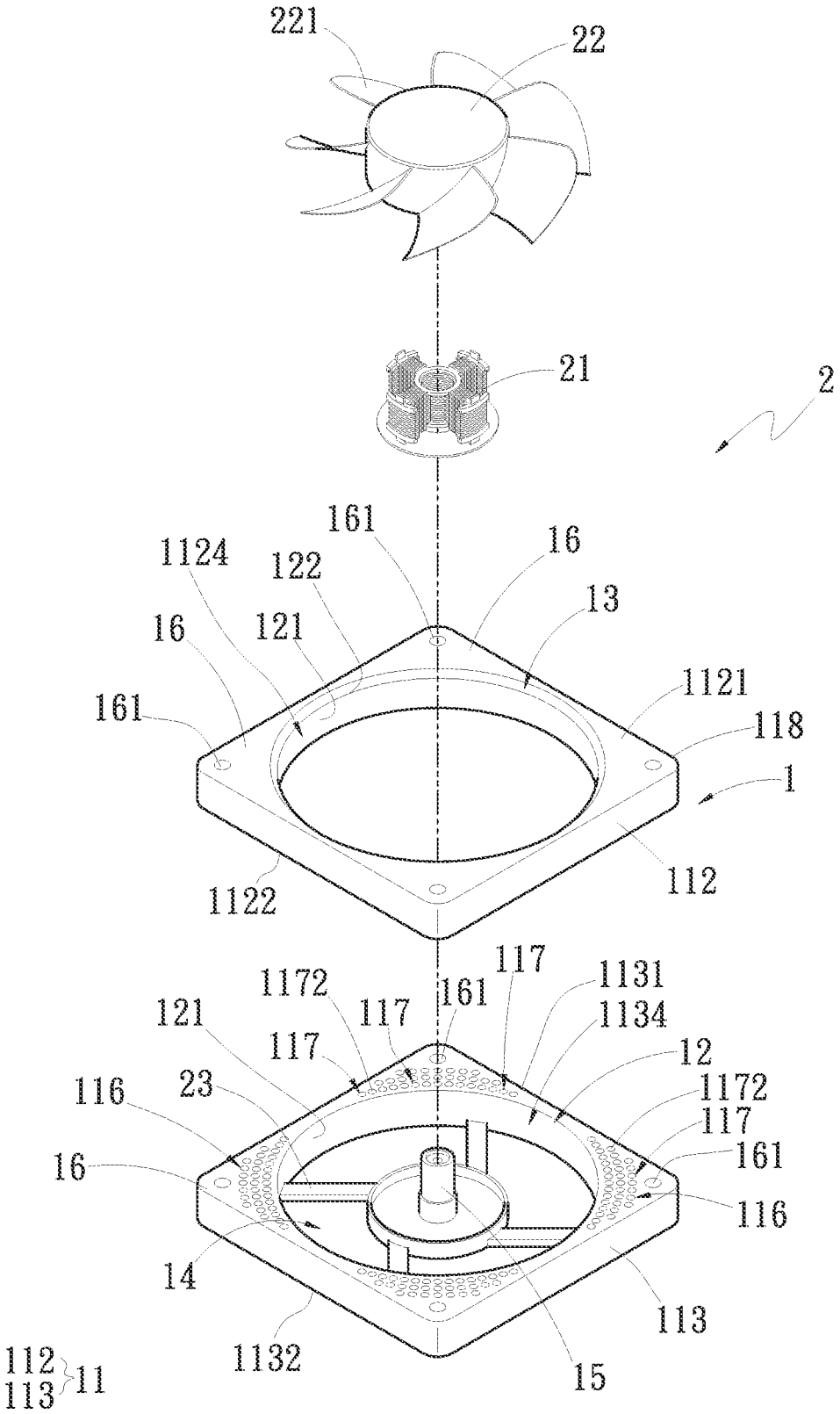
FIG. 1 is an exploded perspective view of a fan frame with noise muffling structure according to a preferred embodiment of the present invention.
Figure 2:
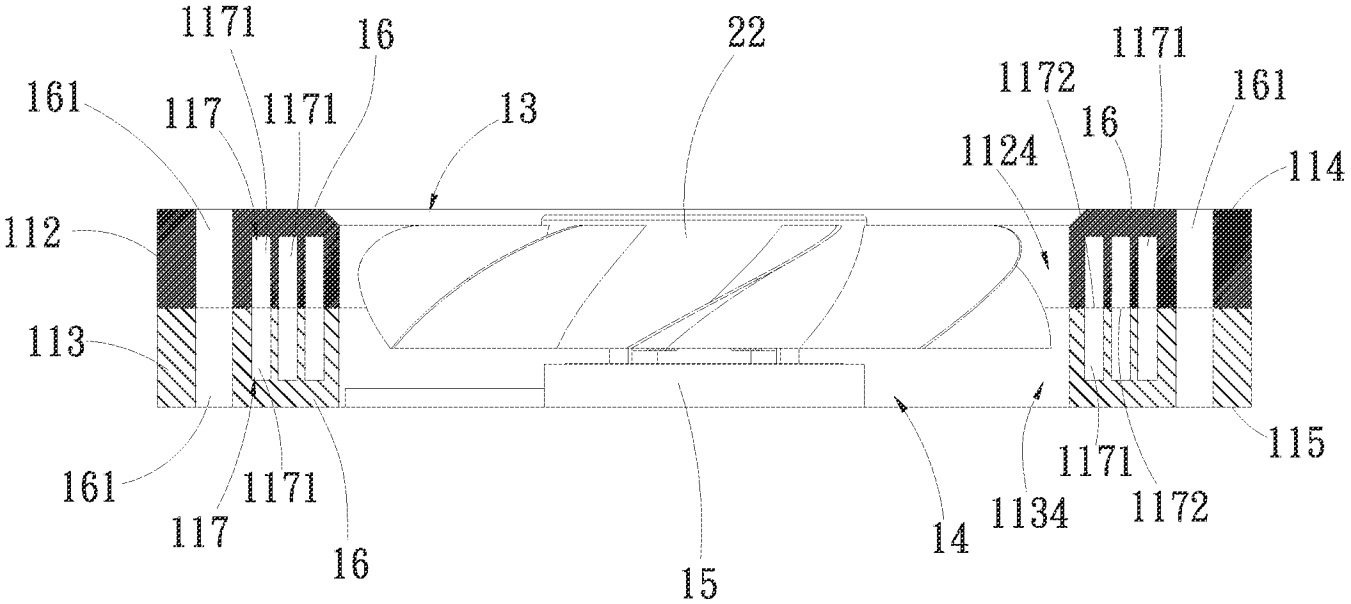
FIG. 2 is an assembled sectional view of the fan frame of FIG. 1.

Please refer to FIGS. 1 and 2, which are exploded perspective view and assembled sectional view, respectively, of a fan frame with noise muffling structure according to a preferred embodiment of the present invention, which is generally denoted by reference numeral of 1 herein. As shown, the fan frame with noise muffling structure 1 includes a frame 11, which can be integrally formed or assembled from multiple parts. In the illustrated embodiment, the fan frame with noise muffling structure 1 is assembled from multiple parts. More specifically, the frame 11 includes a rectangular upper part 112 having a top side 1121 and a bottom side 1122; and a rectangular lower part 113 having a top side 1131 and a bottom side 1132. The bottom side 1122 of the upper part 112 is serially connected to the top side 1131 of the lower part 113 to constitute the frame 11, such as an axial fan frame. Further, the top side 1121 of the upper part 112 and the bottom side 1132 of the lower part 113 form a top 114 and a bottom 115 of the frame 11, respectively.

The upper part 112 and the lower part 113 respectively have a central area defined as an upper passage 1124 and a lower passage 1134. The upper passage 1124 extends from the top side 1121 to the bottom side 1122 of the upper part 112; and the lower passage 1134 extends from the top side 1131 to the bottom side 1132 of the lower part 113. Further, the upper passage 1124 and the lower passage 1134 are serially connected to together constitute an air flow passage 12 extended from the top 114 to the bottom 115 of the frame 11. The air flow passage 12 has an air inlet 13 formed on the top 114 of the frame 11 and an air outlet 14 formed on the bottom 15 of the frame 11, and both the air inlet 13 and the air outlet 14 are communicable with the air flow passage 12. The air flow passage 12 has a passage inner wall 121, which defines a passage circumferential periphery 122.

A shaft seat 15 is provided at a center of the air outlet 14, and is connected to the passage inner wall 121 of the lower passage 1134 via a plurality of supporting sections 23, such as ribs or stationary blades. The upper part 112 and the lower part 113 of the frame 11 respectively have four corners, each of which forms a corner area 16. Each of the corner areas 16 on the upper part 112 and the lower part 113 is provided with a screw hole 161, which extends from the top side 1121, 1131 to the bottom side 1122, 1132. That is, the screw holes 161 are extended through the frame 11 from the top 114 to the bottom 115. In an alternative embodiment, the frame 11 is an integrally formed frame.

Please refer to FIGS. 1 and 2 again. The frame 11 and/or at least one corner area 16 of the frame 11 is defined as a noise muffling zone 116, which is located between the passage circumferential periphery 122 and a frame outer periphery 118 of the frame 11. More specifically, the noise muffling zone 116 is located in a portion of the corner area 16 between the screw hole 161 and the passage circumferential periphery 122. In the illustrated preferred embodiment, the upper part 112 and the lower part 113 respectively have four corner areas 16, and each of which is provided with one noise muffling zone 116. However, the above illustration is non-restrictive. In another embodiment, the upper part 112 and the lower part 113 respectively have one or more corner areas 116 provided with the noise muffling zone 116.

The noise muffling zone 116 in each of the corner areas 16 of the upper and the lower part 112, 113 is provided with at least one noise muffling unit 117. The noise muffling unit 117 is formed between the top side and the bottom side 1121, 1122 and 1131, 1132. In the illustrated preferred embodiment, there is a plurality of noise muffling units 117 provided in each of the noise muffling zones 116, and each of the noise muffling units 117 is a round hole (i.e. a hole with round cross section). However, it is understood the present invention is not limited thereto. In practical implementation of the present invention, the noise muffling units 117 can be a plurality of holes with a square, triangular, curved, oval, rectangular, or irregular cross section.

More specifically, the noise muffling units 117 in the four corner areas 16 are sunken into the bottom side 1122 of the upper part 112 and the top side 1131 of the lower part 113; and the noise muffling units 117 are arrayed in several rows from the passage circumferential periphery 122 of the air flow passage 12 toward the frame outer periphery 118 of the frame 11. The noise muffling units 117 in each raw on the upper part 112 and the lower part 113 are spaced from one another along the passage circumferential periphery 122 of the air flow passage 12; and all the noise muffling units 117 are isolated from the upper passage 1124 and the lower passage 1134 by the passage inner wall 121 of the upper and the lower part 112, 113, so that the noise muffling units 117 on the upper part 112 and the lower part 113 do not communicate with the air flow passage 12.

Further, each of the noise muffling units 117 on the upper and the lower part 112, 113 internally defines a hollow cavity 1171, which is closed between and not extended through the top 114 and the bottom 115 of the frame 11. That is, the hollow cavities 1171 on the upper part 112 and the lower part 113 are not communicable with external environment. The sealed hollow cavities 1171 on the upper and the lower part 112, 113 can absorb the vibration of the frame 11 and the noise produced by such vibration.

Please refer to FIG. 2. The hollow cavity 1171 of each noise muffling unit 117 on the upper and the lower part 112, 113 further includes an opening 1172 formed on the bottom side 1122 of the upper part 112 and the top side 1131 of the lower part 113. The openings 1172 on the bottom side 1122 and the top side 1131 are located opposite to and faced toward each other correspondingly. The hollow cavities 1171 correspondingly formed on the upper and the lower part 112, 113 with their openings 1172 faced toward to each other are closed when the upper and the lower part 112, 113 are aligned with and connected to each other. At this point, the openings 1172 are isolated from external environment and the hollow cavities 1171 on the upper part 112 and the hollow cavities 1171 on the lower part 113 are communicable with one another via the openings 1172 between them. However, the above illustration is non-restrictive. In other embodiments, the openings 1172 on the two facing sides of the upper and the lower part 112, 113 can be arranged in a staggered manner without communicating with one another.

In the illustrated embodiment, the noise muffling units 117 are arranged in multiple rows in the corner areas 16 of the upper and the lower part 112, 113. In another operable embodiment, there can be only one or a plurality of noise muffling units 117 in the form of one single or a plurality of holes or recesses arranged in one row in at least one or all of the four corner areas 16 on the upper and/or the lower part 112, 113.

In the above description, the openings 1172 of the hollow cavities 1171 of the noise muffling units 117 are formed on two facing sides of the upper and the lower part 112, 113. However, in other operable embodiments, the openings 1172 of the hollow cavities 1171 of the noise muffling units 117 can be formed on only one of the two facing sides of the upper and the lower part 112, 113, such as on the bottom side 1122 of the upper part 112 or the top side 1131 of the lower part 113.

In another embodiment, the openings 1172 of the hollow cavities 1171 of the noise muffling units 117 are formed on the top side 1121 of the upper part 112 and/or the bottom side 1322 of the lower part 113; and the openings 1172 are closed with at least one sealing member, such that the hollow cavities 1171 of the noise muffling units 117 are enclosed in the upper part 112 and/or the lower part 113 without communicating with external environment and can absorb the vibration of the upper and lower part 112, 113 and the broadband noise produced by the vibration.

Please refer back to FIG. 1. A stator assembly 21 is fitted around the shaft seat of the frame 11, and a fan wheel 22 having a plurality of blades 221 is pivotally mounted on the shaft seat 15 to be located in the air flow passage 12. The frame 11 and the stator assembly 21 and the fan wheel 22 together constitute a fan 2, such as an axial fan 2. When the fan wheel 22 of the fan 2 rotates to suck in an air flow, the air flow is guided by the air inlet 13 at the upper part 112 into the air flow passage 12. In the course the blades 221 of the fan wheel 22 push and pressurize the air flow, the air flow would collide with the passage inner wall 121 of the air flow passage 12 to therefore vibrating the frame 11. At this point, the hollow cavities 1171 of the noise muffling units 117 in the upper and the lower part 112, 113 can absorb or isolate the vibration to reduce the broadband noise caused by the vibration. Meanwhile, the air flow being pressurized by the blades 221 flows out of the frame via the air outlet 14.

Figure 3:
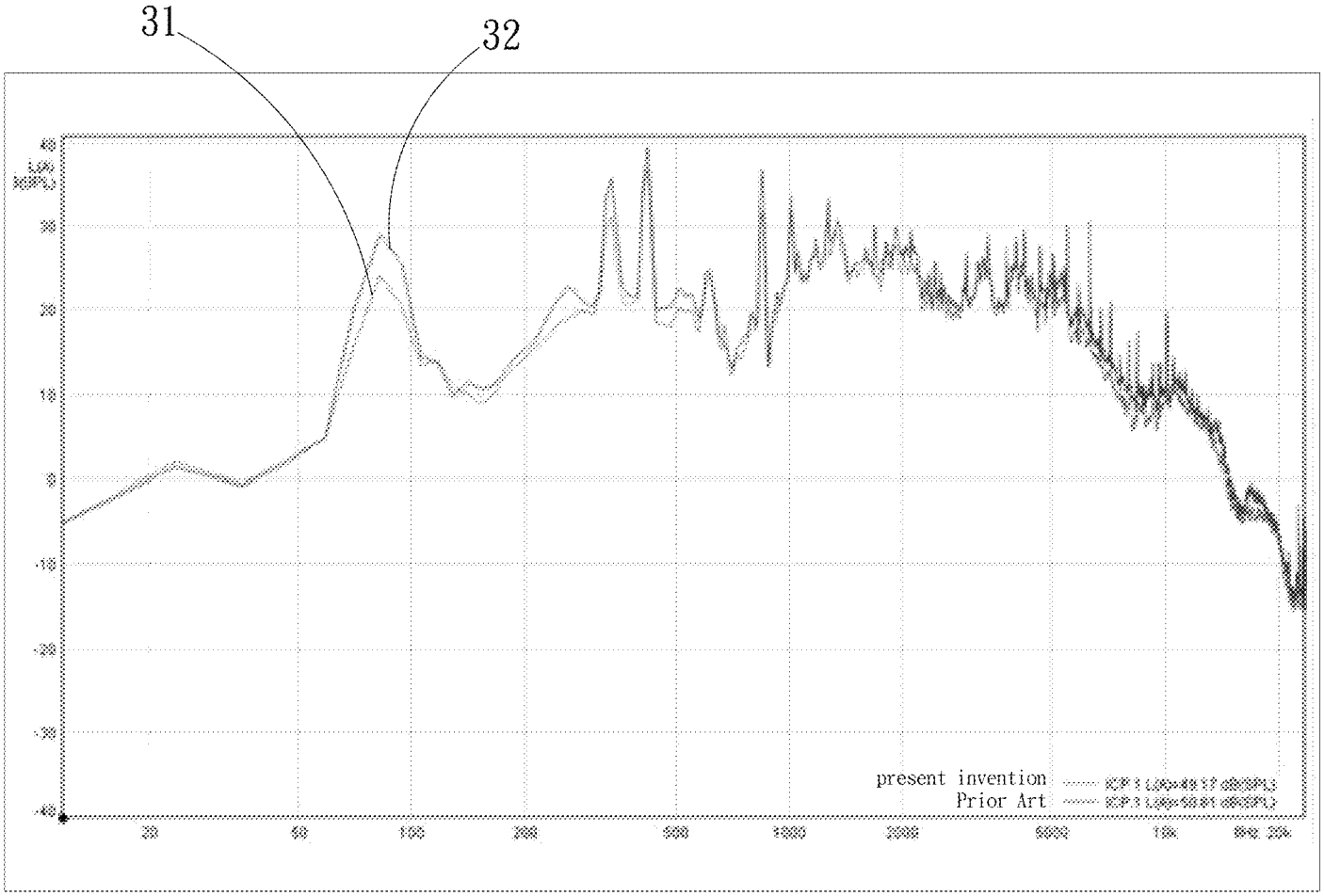
FIG. 3 is a graph showing spectrum comparison of the broadband noise of the present invention and the prior art.

Please refer to FIG. 3, which is a graph of spectrum comparison of the broadband noise of the present invention and the prior art. On the graph, the vertical axis represents sound pressure level (SPL) measured in dB (SPL), and the horizontal axis represents frequency (f) measured in Hz. As shown in FIG. 3, the green curve 31 representing the broadband noise produced by the present invention is lower than the red curve 32 representing the broadband noise produced by the prior art; and the fan broadband noise of the present invention is 49.17 dB (SPL), which is significantly lower than the fan broadband noise of 50.61 dB (SPL) of the prior art. Therefore, compared to the prior art, the present invention effectively reduces the fan broadband noise.

With the noise muffling units 117 of the present invention that have hollow cavities 1171 closed in between the upper part 112 and/or the lower part 113 of the frame 11 of a fan 2, the vibration of the frame 11 and the broadband noise produced by such vibration can be effectively absorbed or reduced to achieve the purpose of reducing noise.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan frame with noise muffling structure, comprising: an axial fan frame having a top and a bottom, and defining a centered air flow passage that extends from the top to the bottom and has a passage inner wall, an air inlet formed on the top and an air outlet formed on the bottom; the axial fan frame further having a noise muffling zone in at least one area of the axial fan frame located between the passage inner wall of the air flow passage and a frame outer periphery of the axial fan frame; the noise muffling zone having at least one noise muffling unit provided therein; the at least one noise muffling unit located between the top and the bottom and being isolated from, and not communicating with, the air flow passage; the at least one noise muffling unit internally defining a hollow cavity, which is closed in between but not extended through the top and the bottom; and the hollow cavity being horizontally aligned with a plurality of blades of a fan wheel in the air flow passage, so that the hollow cavity can absorb vibration of the frame and noise produced by the frame vibration.

2. The fan frame with noise muffling structure as claimed in claim 1, wherein the frame has four corners, which respectively provide a corner area; and the hollow cavity of the at least one noise muffling unit being located in the noise muffling zone in the corner area.

3. The fan frame with noise muffling structure as claimed in claim 1, wherein the noise muffling unit is a hole.

4. The fan frame with noise muffling structure as claimed in claim 1, wherein the frame includes an upper part and a lower part assembled to each other; two opposite sides between the upper and the lower part being correspondingly faced toward each other; the hollow cavity of the at least one noise muffling unit having an opening formed on at least one of the two opposite sides on between the upper and the lower part; and the opening being closed by the opposite side facing it when the upper and the lower part are assembled to each other.

5. The fan frame with noise muffling structure as claimed in claim 4, wherein the noise muffling unit has a round cross section.

6. The fan frame with noise muffling structure as claimed in claim 1, wherein there is a plurality of noise muffling units being arrayed in multiple rows in the noise muffling zone.

* * * * *